US008628317B2

(12) United States Patent
Heaps et al.

(10) Patent No.: US 8,628,317 B2
(45) Date of Patent: Jan. 14, 2014

(54) VACUUM PUMP WITH AN AXIAL OIL FEED CONDUIT

(75) Inventors: David Heaps, Haworth (GB); John Hegarty, Wakefield (GB)

(73) Assignee: Wabco Automotive UK Limited, Morley, Leeds (GB)

( * ) Notice: Subject to any disclaimer, the term of this patent is extended or adjusted under 35 U.S.C. 154(b) by 623 days.

(21) Appl. No.: 12/293,868

(22) PCT Filed: Apr. 5, 2007

(86) PCT No.: PCT/GB2007/001314

§ 371 (c)(1), (2), (4) Date: Jul. 21, 2009

(87) PCT Pub. No.: WO2007/116216

PCT Pub. Date: Oct. 18, 2007

(65) Prior Publication Data

US 2010/0239440 A1 Sep. 23, 2010

(30) Foreign Application Priority Data

Apr. 10, 2006 (GB) ..... 0607198.9

(51) Int. Cl.
*F04C 29/02* (2006.01)
*F04C 18/344* (2006.01)

(52) U.S. Cl.
USPC ..... 418/87; 417/364; 418/76; 418/94

(58) Field of Classification Search
USPC ..... 417/294, 310, 311, 364, 507; 418/76, 418/87, 94, 167, 259, 260
See application file for complete search history.

(56) References Cited

U.S. PATENT DOCUMENTS 2,654,532 A * 10/1953 Nichols ..... 418/84
2,737,341 A * 3/1956 Bitzer ..... 417/364

(Continued)

FOREIGN PATENT DOCUMENTS

DE 3325261 1/1985
DE 3841329 6/1989

(Continued)

OTHER PUBLICATIONS

Minivac Vane Pumps (http://web.archive.org/web/20050214035516/http://minivacpumps.com/oillubricated.html) dated Feb. 14, 2005.*

(Continued)

*Primary Examiner* — Devon Kramer
*Assistant Examiner* — Nathan Zollinger
(74) *Attorney, Agent, or Firm* — Downs Rachlin Martin PLLC

(57) ABSTRACT

A vacuum pump (10) suitable for mounting at a lower region of an engine such as in the oil sump of an engine. The vacuum pump (10) includes a casing (12) having a cavity (14) containing a movable member (18), wherein the cavity (14) is provided with an inlet (32) and an outlet (34) and the movable member (18) is movable to draw fluid into the cavity (14) through the inlet (32) and out of the cavity (14) through the outlet (34) so as to induce a reduction in pressure at the inlet. The vacuum pump (10) is further provided with an oil feed conduit (84) to supply oil to the cavity (14), the oil feed conduit (84) being provided with a valve (86) to prevent the flow of oil to the cavity (14) during periods when the pump is not operating.

8 Claims, 2 Drawing Sheets

(56) References Cited

U.S. PATENT DOCUMENTS

Figure 1:
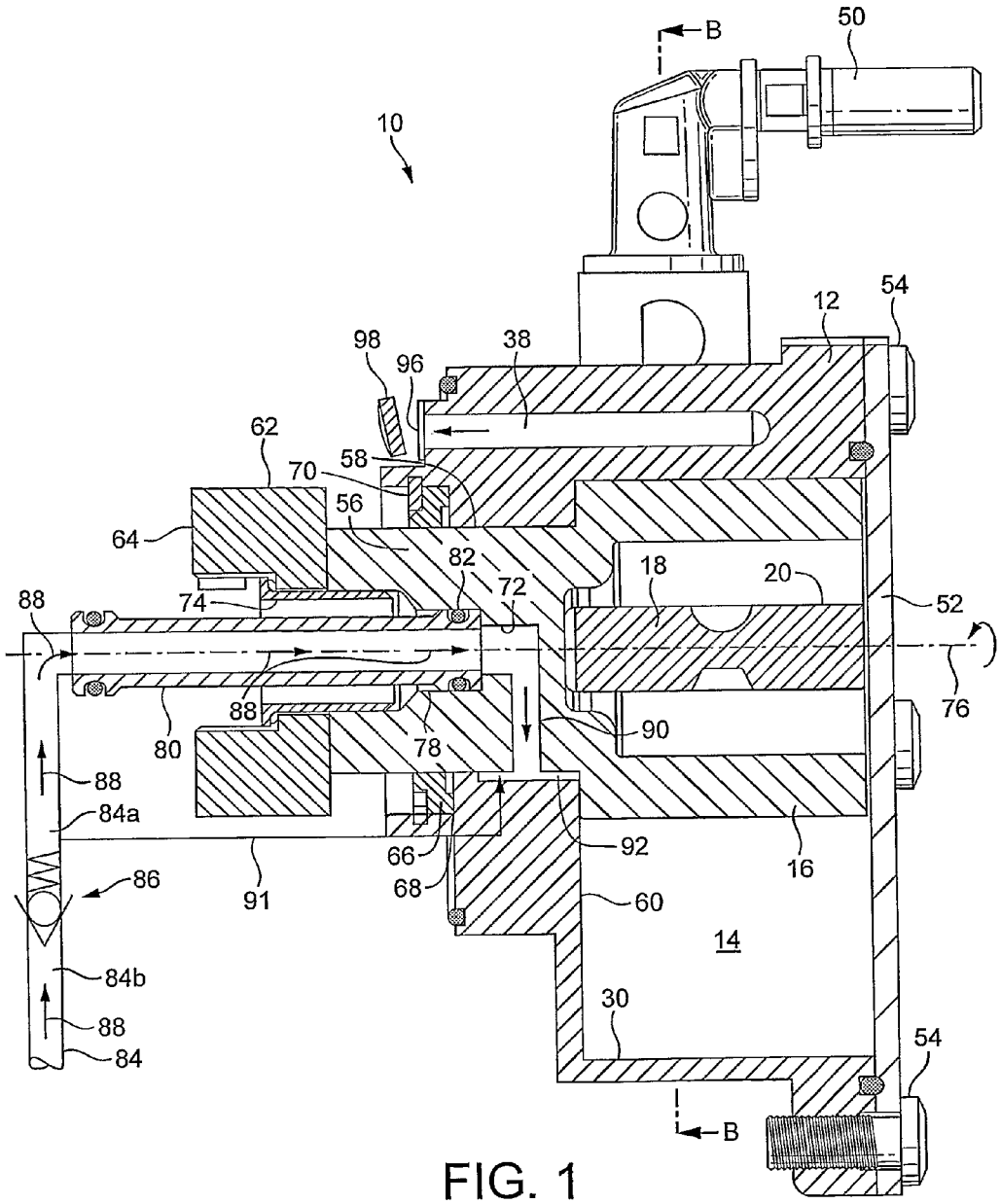

| | | | | |
|---|---|---|---|---|
| 3,707,339 | A * | 12/1972 | Budgen | 418/13 |
| 4,478,562 | A * | 10/1984 | Schippers et al. | 418/88 |
| 4,604,041 | A * | 8/1986 | Hertell et al. | 418/82 |
| 5,181,414 | A * | 1/1993 | Baret et al. | 73/40.7 |
| 5,236,313 | A * | 8/1993 | Kim | 417/281 |
| 6,019,585 | A * | 2/2000 | Abelen et al. | 418/88 |
| 6,190,149 | B1 * | 2/2001 | Richman | 418/94 |
| 7,896,631 | B2 * | 3/2011 | Kishi et al. | 418/255 |
| 2002/0100507 | A1 | 8/2002 | Hauser et al. | |
| 2008/0240962 | A1 * | 10/2008 | Ono et al. | 418/83 |

FOREIGN PATENT DOCUMENTS

| | | | | |
|---|---|---|---|---|
| EP | 0761975 | | 3/1997 | |
| EP | 1120568 | | 8/2001 | |
| GB | 594441 | | 11/1947 | |
| GB | 796924 | | 6/1958 | |
| GB | 1327521 | | 8/1973 | |
| GB | 2069610 | | 8/1981 | |
| GB | 2211572 | | 7/1989 | |
| JP | 49011645 | | 3/1974 | |
| JP | 55134784 | | 10/1980 | |
| JP | 59180095 | | 10/1984 | |
| JP | 62048987 | | 3/1987 | |
| JP | 62174591 | | 7/1987 | |
| JP | 63193788 | | 8/1988 | |
| JP | 1164670 | | 6/1989 | |
| JP | 7208339 | A | 8/1995 | |
| JP | 10238469 | | 9/1998 | |
| JP | 5088391 | | 2/1999 | |
| JP | 3070980 | | 8/2000 | |
| JP | 2001248741 | | 9/2001 | |
| JP | 2002005036 | | 1/2002 | |
| JP | 2003343462 | | 12/2003 | |
| JP | 2004011421 | | 1/2004 | |
| JP | 2005256684 | A * | 9/2005 | F04C 18/344 |
| WO | 2009103646 | | 3/1991 | |
| WO | 2006024872 | | 3/2006 | |

OTHER PUBLICATIONS

International Search Report issued Jul. 19, 2007, in International Application No. PCT/GB2007/001314 filed on Apr. 5, 2007.

UK Patent Office Search Report issued Dec. 5, 2006, in United Kingdom Application No. 0607198.9 filed on Apr. 10, 2006.

Office Action Summary dated Dec. 20, 2011, in related JP Patent Application No. 2009-504812.

Office Action Summary dated Oct. 23, 2012, in related JP Patent Application No. 2009-504812.

* cited by examiner

VACUUM PUMP WITH AN AXIAL OIL FEED CONDUIT

The present invention relates to a vacuum pump and particularly to an automotive vacuum pump.

Vacuum pumps may be fitted to road vehicles with fuel injected spark ignition engines or compression ignition engines to boost braking performance. Typically, the vacuum pump is driven by a camshaft of the engine which necessitates the mounting of the pump to an upper region of the engine. It is advantageous to keep the overall size of the engine as small as possible to assist in the positioning of the engine within a vehicle body. To this end, it has been proposed to position the vacuum pump at or in a lower region of the engine, for example within the sump of the engine. Moving the vacuum pump to a lower position can assist in the lowering of the centre of gravity of the vehicle and can improve the passenger impact protection of the vehicle.

According to the present invention there is provided a vacuum pump suitable for mounting at a lower region of an engine such as in the oil sump of an engine, the vacuum pump including a casing having a cavity containing a movable member, wherein the cavity is provided with an inlet and an outlet and the movable member is movable to draw fluid into the cavity through the inlet and out of the cavity through the outlet so as to induce a reduction in pressure at the inlet, wherein further the vacuum pump is provided with an oil feed conduit to supply oil to the cavity, the oil feed conduit being provided with a valve to prevent the flow of oil to the cavity during periods when the pump is not operating.

The provision of the valve in the oil feed conduit prevents oil from entering the cavity during non-operative periods, for example, when the engine to which the pump is fitted is switched off. The valve prevents oil being drawn into the cavity by residual vacuum within the cavity, or by the draining of oil by gravity from points in the engine oil feed system which are higher than the position of the pump. It will be appreciated that this problem is encountered when moving the vacuum pump to a lower position on or in the engine. This in turn prevents the need for the rotor and vane to pump oil which has accumulated in the cavity through the cavity outlet once operation of pump is restarted. The pumping of oil in this manner can exert forces on the vane which result in premature wear of the vane, especially in instances where the viscosity of the oil has increased. Such a situation may occur where there is a significant drop in ambient temperature between the stopping and restarting of the vacuum pump.

The oil feed conduit valve preferably includes a movable valve member which is movable between an open position and a closed position. The oil feed conduit valve preferably also includes a resilient means operable to urge the valve member to the closed position when the pump ceases operation. The resilient means may comprise a separate resilient member such as a spring. Alternatively, the resilient means may comprise a resilient portion of the valve member. The oil feed conduit valve may be provided within the pump casing. Alternatively, the oil feed conduit valve may be provided in a portion of the oil feed conduit separate from the pump casing.

In a preferred embodiment, the inlet to the pump cavity is provided with a valve which is arranged to close when the pump is not operating. This inlet valve acts to maintain the reduction in pressure induced by operation of the pump in a conduit upstream of the pump inlet. The inlet valve may be housed in a conduit member which is fitted to the pump casing and which conduit member is in fluid communication with the cavity inlet. The inlet valve preferably includes a movable valve member which is movable between an open position and a closed position. The inlet valve preferably also includes a resilient means operable to urge the valve member to the closed position when the pump ceases operation. The resilient means may comprise a separate resilient member such as a spring. Alternatively, the resilient means may comprise a resilient portion of the valve member.

The oil feed conduit may extend through the casing from the exterior thereof to the cavity. Alternatively, the oil feed conduit may extend through a movable member of the pump to the cavity. The oil feed conduit may communicate with an oil gallery of the pump, which oil gallery in turn feeds oil to the cavity. In such an embodiment, the oil gallery may be defined between a movable member of the pump and the casing.

Figure 2:
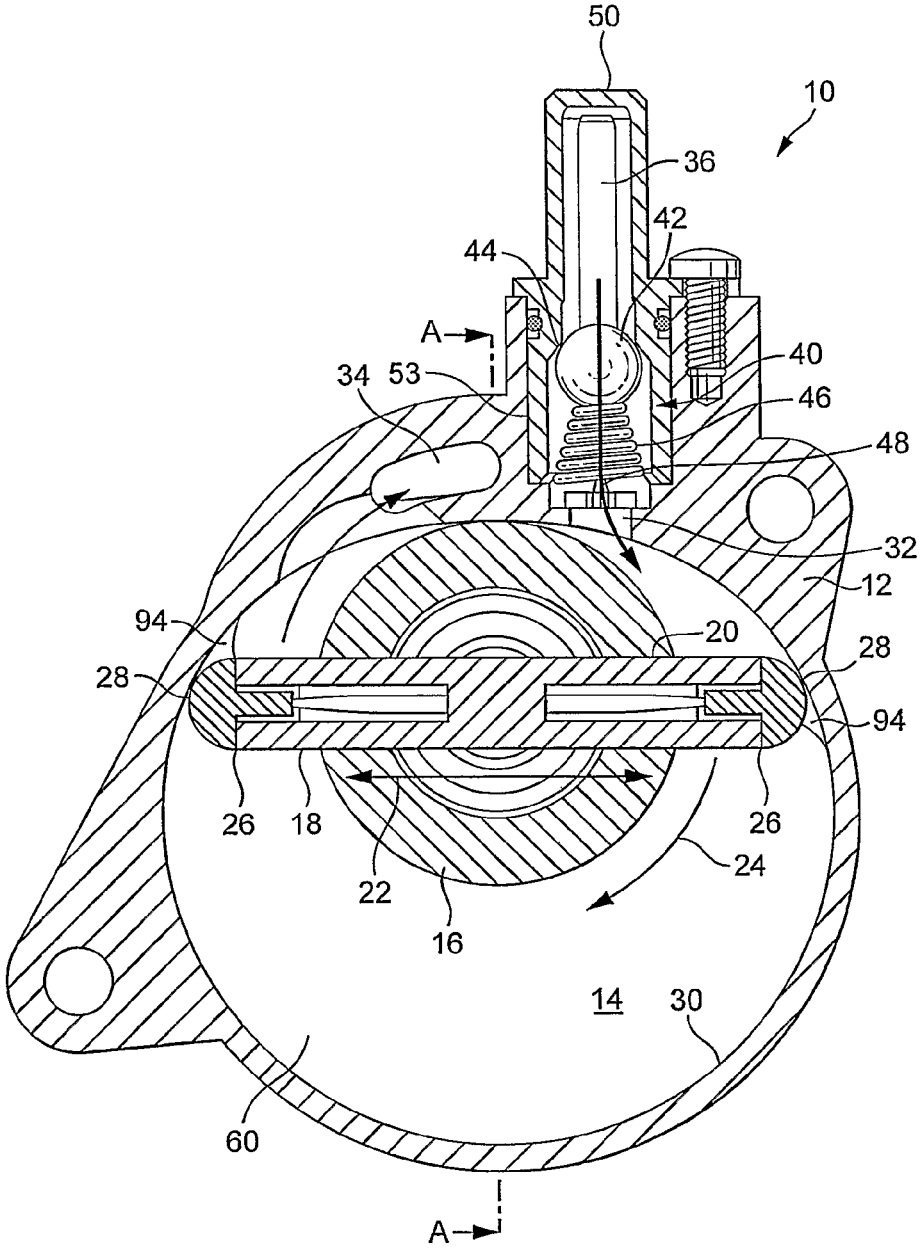

An embodiment of the present invention will now be described with reference to the accompanying figures in which:

FIG. 1 shows a cross-sectional view of a vacuum pump according to the present invention; and FIG. 2 shows an alternative cross-sectional view of the vacuum pump of FIG. 1.

Referring to the figures there is shown a vacuum pump, generally designated 10, which is intended to be located within the oil sump of an engine. The cross-sectional view of FIG. 1 is indicated by arrows A-A of FIG. 2, while the cross-sectional view of FIG. 2 is indicated by arrows B-B of FIG. 1. The pump includes a casing 12 within which there is defined a cavity 14. Within the cavity 14 there is provided a rotor 16 and a vane 18. The vane 18 is slidably mounted in a slot 20 of the rotor 16 and is slidably movable relative to the rotor 16 as indicated by arrows 22. The rotor 16 is rotatable relative to the casing 12 as indicated by arrow 24. The ends 26 of the vane 18 are provided with seals 28 which ensure that a substantially fluid tight seal is maintained between the vane 18 and the wall 30 of the cavity 14 as the vane 18 is rotated by the rotor 16. As will be described in greater detail below the seals 28 are assisted in the provision of the fluid tight seal by the presence of oil in the cavity 14.

The cavity 14 is provided with an inlet 32 and an outlet 34. The inlet 32 is connected to a conduit 36 which in turn is connected to a brake booster arrangement of a vehicle (not shown). The cavity outlet 34 is in fluid communication with a conduit 38 extending through the casing 12 to the exterior thereof and into the crankcase chamber of the engine. At the end of the conduit 38 remote from the cavity outlet 34 there is provided a reed valve 96 and a stop 98 which constrains the amount by which the reed valve 96 can open. The reed valve 96 prevents crankcase air and/or unfiltered oil from being drawn into the cavity 14 when operation of the pump 10 ceases. The cavity 14 is closed by a plate 52 attached to the casing 12 by threaded fasteners 54.

The inlet conduit 32 is provided with a non-return valve generally designated 40. The non-return valve 40 comprises a spherical valve member 42 which is urged against a seat 44 of the conduit 36 by a spring 46. The strength of the spring 46 is such that flow through the conduit 36 (indicated by arrow 48) to the inlet 32 induced by the rotation of the rotor 16 and vane 18 causes the spring 46 to compress and the valve member 42 to move from its seat 44. Upon cessation of this flow 48 the valve member 42 is urged back against its seat 44 thereby closing the conduit 36. In the embodiment shown the conduit 36 is defined by an elbow shaped tubular member 50 which is fitted to a recess 53 of the casing 12 which surrounds the inlet 32. The valve seat 44 is defined by an annular step of the tubular member 50. It will be appreciated that the other forms and configurations of non-return valve may be employed.

The rotor 16 is provided with a shaft portion 56 which extends through an aperture 58 provided in a rear face 60 of the cavity 14 such that the distal end 62 of the shaft portion 56 projects from the casing 12. The shaft portion 56 is provided with a drive coupling 64 which, in use, enables the rotor 16 to be connected to a drive member (not shown). The shaft portion 56 is surrounded by an oil seal 66 which is received in an annular recess 68 of the casing 12. The oil seal 66 is retained to the recess 68 by a split ring 70.

Both the rotor shaft portion 56 and the drive coupling 64 are hollow and are provided with respective through apertures 72, 74 which are aligned with the axis of rotation 76 of the rotor 16. The rotor shaft portion aperture 72 is provided with an enlarged diameter portion 78 to which an oil feed tube 80 can be fitted. The oil feed tube 80 is provided with an annular seal in the form of an elastomeric O-ring 82 to ensure that a fluid tight connection is made between the tube and the rotor shaft portion 56. The oil feed tube 80 is connected to an oil feed conduit 84. The oil feed conduit 84 is connected to a source of filtered oil. For example, the oil feed conduit may be fed by the outlet of the an oil filtration arrangement of the engine to which the vacuum pump 10 is fitted. Within the conduit 84 there is provided a non-return valve generally designated 86. The non-return valve 86 may be of similar type to that described with reference to the inlet no-return valve 40 and comprise a valve member, spring and seat. Alternatively, another form or configuration of non-return valve may be employed. The oil feed conduit 84 may be considered to have a downstream side 84*a* and an upstream side 84*b* on opposing sides of the non-return valve 86. The terms upstream and downstream are construed with reference to the flow of oil through the non-return valve 86.

In use, filtered oil is fed to the oil feed tube 80 through the oil feed conduit 84 as indicated by arrows 88. The oil then passes from the feed tube 80 to the rotor shaft portion aperture 72 whereupon it passes through a radial conduit 90 of the shaft portion 56 to an oil gallery 92. The oil gallery 92 is defined by a recess in the aperture 58 to which the shaft portion 56 is mounted. Oil present in the gallery 92 is able to flow into the cavity 14 between the rotor 16 and the rear face 60 of the cavity 14. The presence of oil in the cavity 14 lubricates the sliding surfaces of the pump 10 to prevent seizure. A small amount of oil 94 is pushed ahead of the rotor seals 28 as they rotate. The oil 94 is ejected from the cavity 14 through the outlet 34 and outlet conduit 38. It will thus be appreciated that a constant flow of oil into the cavity 14 is required when the rotor 16 and vane 18 are rotating in order to replace the oil ejected from the cavity 14 via the outlet 34.

It will be appreciated that oil may be fed to the cavity through other paths. For example, oil may be fed to the oil gallery 92 from the downstream side 84*a* of the oil feed conduit 84 through a passageway in the casing 12 as indicated by arrow 91

Operation of the pump 10 will now be described. The rotor 16 and vane 18 are rotated by the driver connected to the pump drive member 64. This rotation results in air being drawn into the cavity 14 through the inlet 32 and inlet conduit 36. The non-return valve 40 is caused to open in the manner described above. A reduction in pressure is thus experienced in the inlet conduit 36 and any item, equipment or assembly connected to the inlet conduit. The air drawn into the cavity 14, together with any oil entrained by the vane 18 is ejected from the cavity 14 through the outlet 34 and outlet conduit 38. Air and oil exists the outlet conduit 38 by opening the reed valve 96. As described above, filtered oil is supplied to the cavity 14 via the oil feed conduit 84 and oil feed tube 88.

Once rotation of the rotor 16 and vane 18 stops, the inlet non-return valve 40 closes. This ensures that the reduced pressure on the inlet conduit 36 is maintained. The oil feed non return valve also closes 86 and thereby prevents filtered oil from being drawn into the oil gallery 92 and subsequently the chamber 14 by the residual vacuum within the cavity 14. Without the oil feed non-return valve 86, the chamber 14 may, over time, become flooded with oil. When rotation of the rotor 16 and vane 18 is recommenced, the oil must be ejected from the cavity 14 through the outlet 34. This can produce undue stresses on the vane 18 and its seals 28 leading to premature wear and failure thereof.

The invention has been described with reference to a single sliding vane vacuum pump. It will be appreciated that the invention is equally applicable to other types of vacuum pump including, for example, multi vane and piston pumps. The vacuum pump may be driven either directly or indirectly by a rotatable member of the engine such as, for example the crank shaft or a cam shaft. In an alternative embodiment, the vacuum pump may be driven electrically.

The invention claimed is:

1. A vacuum pump suitable for mounting at a lower region of an engine, the vacuum pump comprising:

a pump casing having an exterior, a cavity within the pump casing, the cavity including a reservoir and a rotor having a rotational axis, an oil gallery defined between the rotor and the casing and radially displaced from the rotational axis so as not to be intersected thereby, and a vane slidably mounted in a slot of the rotor, wherein the cavity is provided with an inlet and an outlet and the rotor and the vane are movable to draw fluid into the cavity through the inlet and out of the cavity through the outlet so as to induce a reduction in pressure at the inlet, wherein the vacuum pump is provided with an oil feed conduit to supply oil to the cavity, the oil feed conduit being in fluid communication with the reservoir via the oil gallery and provided with an oil feed conduit valve to prevent the flow of oil to the cavity during periods when the pump is not operating, the oil feed conduit valve is provided within the pump casing and the oil feed conduit extends through the casing from the exterior thereof to the cavity via the oil gallery, and the inlet to the pump cavity is provided with an inlet valve which is arranged to close when the vacuum pump is not operating.

2. A vacuum pump as claimed in claim 1, wherein the oil feed conduit valve includes a movable valve member which is movable between an open position and a closed position.

3. A vacuum pump as claimed in claim 2, wherein the oil feed conduit valve further includes a resilient means operable to urge the movable valve member to the closed position when the vacuum pump ceases operation.

4. A vacuum pump as claimed in claim 3, wherein the resilient means comprises a spring.

5. A vacuum pump as claimed in claim 1, wherein the inlet valve is housed in a conduit member which is fitted to the pump casing and the conduit member is in fluid communication with the inlet of the cavity.

6. A vacuum pump as claimed in claim 1, wherein the inlet valve includes a movable valve member which is movable between an open position and a closed position.

7. A vacuum pump as claimed in claim 6, wherein the inlet valve includes a resilient means operable to urge the movable valve member to the closed position when the vacuum pump ceases operation.

8. A vacuum pump as claimed in claim 7, wherein the resilient means comprises a spring.

* * * * *